US007773915B2

(12) United States Patent
Akita

(10) Patent No.: US 7,773,915 B2
(45) Date of Patent: Aug. 10, 2010

(54) IMAGE FORMING APPARATUS HAVING AN IMAGE BEARING MEMBER AND A TRANSPARENT TONER DEVELOPER BEARING MEMBER THAT ROTATES IN THE SAME DIRECTION

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 478 days.

(21) Appl. No.: 11/959,154

(22) Filed: Dec. 18, 2007

(65) Prior Publication Data

US 2008/0152390 A1 Jun. 26, 2008

(30) Foreign Application Priority Data

Dec. 21, 2006 (JP) ..... 2006-344277

(51) Int. Cl.
*G03G 15/01* (2006.01)

(52) U.S. Cl. ..... 399/223; 399/227

(58) Field of Classification Search ..... 399/223, 399/227

See application file for complete search history.

(56) References Cited

U.S. PATENT DOCUMENTS

2006/0127134 A1* 6/2006 Sakamaki et al. ..... 399/223
2007/0020538 A1* 1/2007 Kim ..... 430/47
2007/0053726 A1* 3/2007 Noguchi et al. ..... 399/298

FOREIGN PATENT DOCUMENTS

JP 8-220821 8/1996

* cited by examiner

*Primary Examiner*—David M Gray
*Assistant Examiner*—Billy J Lactaoen
(74) *Attorney, Agent, or Firm*—Canon USA Inc IP Div

(57) ABSTRACT

An image forming apparatus having a plurality of image bearing members, a plurality of colored toner developing units, and a transparent toner developing unit. Each colored toner developing unit has a developer bearing member. The rotational direction of the developer bearing members of the colored toner developing units is opposite to the rotational direction of the corresponding image bearing member, and the rotational direction of the developer bearing member of the transparent toner developing unit is the same as the rotational direction of the corresponding image bearing member.

10 Claims, 6 Drawing Sheets

IMAGE FORMING APPARATUS HAVING AN IMAGE BEARING MEMBER AND A TRANSPARENT TONER DEVELOPER BEARING MEMBER THAT ROTATES IN THE SAME DIRECTION

BACKGROUND OF THE INVENTION

1. Field of the Invention

The present invention relates to an image forming apparatus having a process for developing an electrostatic image using two-component developer having toner and carrier. More specifically, the present invention relates to an image forming apparatus that forms an image using colored toners and transparent toner.

2. Description of the Related Art

For example, in the field of electrophotographic image forming apparatus, there is widely used a color image forming apparatus that forms a multicolor image such as a full-color image using a plurality of colors of toner.

Conventional image forming apparatuses use four colors of cyan (C), magenta (M), yellow (Y), and black (BK). With the recent advancement of image forming apparatuses, needs have increased, and image forming apparatuses using an increased number of colors have been proposed. Some of them use light colors such as light cyan and light magenta, which are commonly used in ink jet image forming apparatuses, in addition to the conventional four colors. Japanese Patent Laid-Open No. 8-220821 discloses using transparent toner in addition to the four colors of toner.

The main purpose to add transparent toner is to uniformize the gloss in the image plane. In the case of electrophotographic image formation, a difference in level in the image plane due to the difference in the amount of colored toners causes unevenness of gloss in the image plane. Putting transparent toner so that the amount of transparent toner in a unit area is inversely proportional to the amount of colored toners in the unit area eliminates the difference in level in the image plane and uniformizes the gloss.

There are various types of image forming apparatuses having an increased number of colors of developer. Tandem-type image forming apparatuses form an image using the same number of image bearing members (photosensitive members) as the number of kinds of toners. A tandem-type image forming apparatus using, for example, six colors of developer (toner) includes six tandemly-arranged image forming units. Each image forming unit includes a combination of an image bearing member and a developing device. Each developing device is loaded with developer having a different spectral characteristic.

Known developing methods utilized in electrophotographic methods include a two-component developing method using two-component developer including non-magnetic toner particles (toner) and magnetic particles (carrier) and a one-component developing method that does not use carrier. In the above-described image-quality-oriented image forming apparatuses using light-colored toners or transparent toner, the two-component developing method is often used from the viewpoint of high-resolution and stability of the amount of toner per unit area.

In the two-component developing method, the image on the image bearing member tends to be affected by friction with the magnetic brush of carrier, and image deterioration such as worsening of graininess in a low-density part can occur. A developing method in which the rotational direction of the developer bearing member is opposite to the rotational direction of the image bearing member in the developing region will be referred to as counter developing method. A developing method in which the rotational direction of the developer bearing member is the same as the rotational direction of the image bearing member in the developing region will be referred to as forward developing method. The frictional force between the developer and the image bearing member in the counter developing method is larger than that in the forward developing method. Therefore, graininess worsens significantly. Therefore, in image-quality-oriented image forming apparatuses, the forward developing method is often used to reduce graininess.

However, when the rotational direction of the developer bearing member is the same as the rotational direction of the image bearing member in the developing region, there is concern over a phenomenon in which when a high-density part is behind a low-density part, the rear end of the low-density part decreases in density (missing image) (see FIG. 4).

In many cases, the rotational speed of the image bearing member differs from the rotational speed of the developer bearing member, and the rotational speed of the image bearing member and the rotational speed of the developer bearing member are in the ratio of 1:1 to 1:3. If the rotational speed of the developer bearing member is less than or equal to the rotational speed of the image bearing member, the amount of developer supplied in the developing region is insufficient and therefore a sufficient image density cannot be obtained. Therefore, generally, the rotational speed of the developer bearing member is larger than the rotational speed of the image bearing member. In this case, the following phenomenon occurs around the developing region (FIGS. 5A and 5B). FIG. 5A shows a latent image entering the developing region, the latent image including a high-density part and a low-density part therebehind. In the developing region, toner moves to the image bearing member in accordance with the latent image. The electric charge of two-component developer is substantially zero when toner and carrier are in contact with each other. When the toner moves to the image bearing member and separates from the carrier, for example, in the case where the toner is negatively charged, the two-component developer left behind is positively charged (this phenomenon will hereinafter be referred to as counter charge). As a result, a part of the negative toner moved to the surface of the image bearing member is attracted by the positive charge generated in the two-component developer and re-adheres to the carrier (hereinafter referred to as missing image (FIG. 5B)). Such a missing image phenomenon occurs significantly at the rear end of a low-density part in front of a high-density part because the developer bearing member precedes due to the difference between the rotational speed of the image bearing member and the rotational speed of the developer bearing member.

It is known that the missing image phenomenon is reduced by lowering the resistance of carrier of the two-component developer. The mechanism will be described. As described above, the part of the negative toner moved to the surface of the image bearing member is attracted by the counter charge of the two-component developer and re-adheres to the carrier, thereby causing the missing image phenomenon. Therefore, the missing image is reduced by lowering the amount of counter charge. When the carrier has low resistance, the counter charge generated in the carrier escapes quickly through the sleeve and therefore the positive charge decreases. Therefore, the Coulomb's force between the carrier and the negative toner on the image bearing member decreases. Therefore, the missing image is reduced. However, if the resistance of carrier is too low, the carrier adheres to the image bearing member or the latent image on the image bearing member is disturbed.

A method in which the rotational direction of the developer bearing member is opposite to the rotational direction of the image bearing member in the developing region, that is, a counter developing method can be used to prevent the missing image from occurring. However, as described above, since the difference in speed between the image bearing member and the developer bearing member is larger and the friction force to which the image bearing member is subjected is larger as compared to the forward developing method, the graininess worsens.

Therefore, in conventional four-color (yellow, magenta, cyan, and black) image forming apparatuses, the graininess is reduced using the forward developing method, and the missing image phenomenon is prevented by not lowering the resistance of carrier to the level where the carrier adhesion occurs.

However, image forming apparatuses that are intended to eliminate the difference in toner level in the image plane to uniformize the gloss and that use a plurality of colored toners and transparent toner have the following problem. When the forward developing method is used in every developing device, the missing image phenomenon occurs more significantly in the transparent toner developing device than in the colored toner developing devices. The main cause thereof will be described.

In terms of the function of transparent toner, the maximum amount per unit area of transparent toner used for development in the transparent toner developing device needs to be substantially equal to the total maximum amount of toners used for development in all colored toner developing devices. The reason is that the transparent toner is used to planarize the toner image in the image plane and to thereby uniformize the gloss. To make up the difference between the total maximum amount of colored toners per unit area and the minimum amount (blank part), the amount of transparent toner needs to be equal to the total maximum amount of colored toners. Therefore, for example, when the total maximum amount of toner per unit area in yellow, magenta, cyan, and black toner developing devices is 200% (when the maximum amount of one color of toner per unit area is 100%), the transparent toner developing device needs to use up to twice the amount of toner used in each colored toner developing device.

The missing image phenomenon tends to become more significant with the increase in the maximum amount of toner per unit area under a condition in which the charge amount of toner per unit mass is equal. With the increase in the amount of toner per unit area, more negative toner moves from the two-component developer to the image bearing member, and therefore the positive charge amount of the two-component developer left behind increases. As a result, the Coulomb's force between the negative toner on the image bearing member and the two-component developer increases, and therefore the missing image worsens. In the case of transparent toner, the part of the missing image does not decrease in density unlike in the case of colored toner. However, since the part of the missing image is significantly different in gloss (generally deteriorates in gloss), the uniformity in gloss in the image plane, which is the purpose of use of transparent toner, is diminished.

This worsening of the missing image due to the increase in the amount of toner per unit area can be prevented by lowering the charge amount of toner per unit mass. Since the charge amount of toner per unit mass is lowered, if the amount of toner per unit area increases, the amount of positive charge of the two-component developer generated after development does not increase, and therefore the missing image phenomenon can be restrained. However, if the charge amount of toner per unit mass is too small, the toner scatters outside the latent image due to the centrifugal force due to the rotation of the developer bearing member. This problem is called toner scattering. The maximum amount of transparent toner per unit area needs to be about 200 to 300% of the maximum amount of colored toner per unit area in actual use. It is virtually impossible to lower the charge amount of transparent toner to ½ to ⅓ in consideration of the above-described toner scattering.

As described above, when the forward developing method is used in every developing device, the missing image phenomenon is more significant in the transparent toner developing device than in the colored toner developing devices. In the case of transparent toner, the part of the missing image does not decrease in density unlike in the case of colored toner. However, since the part of the missing image is different in gloss, the uniformity in gloss in the image plane is diminished.

SUMMARY OF THE INVENTION

The present invention is directed to an image forming apparatus that uses a plurality of colored toners and transparent toner and in which unevenness of gloss due to the transparent toner is reduced.

In an aspect of the present invention, an image forming apparatus includes a plurality of rotatable image bearing members, a plurality of colored toner developing units, and a transparent toner developing unit. The plurality of colored toner developing units each have a developer bearing member configured to bear toner and carrier. The colored toner developing units are configured to form colored toner images on the image bearing members opposite the developer bearing members with colored toners. The transparent toner developing unit has a transparent toner developer bearing member configured to bear transparent toner and carrier. The transparent toner developing device forms a transparent toner image on the image bearing member opposite the transparent toner developer bearing member. A maximum amount of toner formed by the transparent toner developing unit is larger than a maximum amount of toner formed by at least one of the colored toner developing units. A rotational direction of the developer bearing members of the colored toner developing units is opposite to a rotational direction of the corresponding image bearing members, and a rotational direction of the transparent toner developer bearing member is the same as a rotational direction of the corresponding image bearing member.

Further features of the present invention will become apparent from the following description of exemplary embodiments with reference to the attached drawings.

DESCRIPTION OF THE EMBODIMENTS

An image forming apparatus according to an embodiment of the present invention will be described with reference to the drawings. It should be noted that the sizes, materials, shapes, and relative positions of components of the image forming apparatus are not intended to limit the scope of the present invention unless otherwise specified.

First Embodiment

Overall Structure and Operation of Image Forming Apparatus

Figure 1:
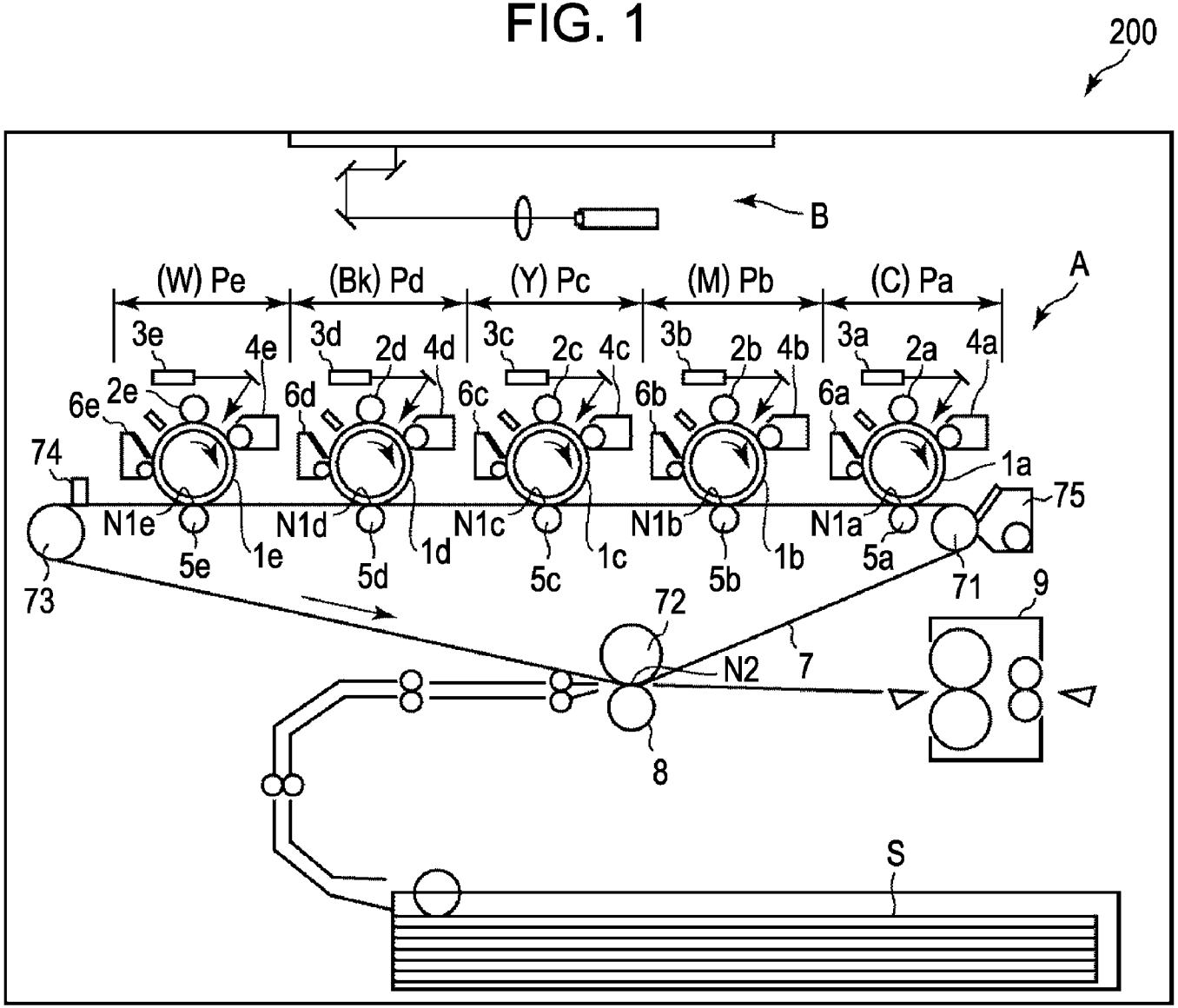
FIG. 1 is a schematic sectional view showing the structure of an image forming apparatus according to an embodiment of the present invention.

FIG. 1 is a schematic sectional view of an image forming apparatus according to an embodiment of the present invention. The image forming apparatus 200 of this embodiment is a full-color image forming apparatus that can form a full-color image according to an image information signal on a recording material S using an electrophotographic method. The image forming apparatus 200 of this embodiment is a tandem type in which a plurality of photosensitive drums (image bearing members) are arranged one behind another. The image forming apparatus 200 uses a reversal developing method in development, an intermediate transfer method in transfer, and a heating and pressing fixation method in fixation.

The image forming apparatus 200 has a printer portion A and a reader portion B. The reader portion B optically reads an image of a document on a document plate, converts the image into a color-separated electric signal, and sends the signal to the printer portion A. The printer portion A forms a full-color image according to the image information signal.

The printer portion A includes first, second, third, fourth, and fifth image forming units (stations) Pa, Pb, Pc, Pd, and Pe. Each station Pa to Pe has a photosensitive drum 1*a* to 1*e* serving as an image bearing member. Each of the five photosensitive drums 1*a* to 1*e* is provided with a developing device 4*a* to 4*e* loaded with developer including toner having a different spectral characteristic. The stations Pa to Pe each including a combination of an image bearing member 1*a* to 1*e* and a developing device 4*a* to 4*e* are tandemly arranged along the moving direction of the surface of an intermediate transfer belt 7 serving as an intermediate transfer member.

In this embodiment, the first station Pa forms an image using transparent toner. The second, third, fourth, and fifth stations Pb, Pc, Pd, and Pe form images using cyan (C), magenta (M), yellow (Y), and black (Bk) toners.

Components common to the colors will hereinafter be described as a whole and the letters a, b, c, d, and e added to reference numeral or letter to differentiate the components will hereinafter be omitted unless the components need to be differentiated.

The drum-shaped photosensitive members (photosensitive drums) 1 serving as image bearing members are supported rotatably in the direction of an arrow in the figure. Around each photosensitive drum 1 are disposed a charging device (charging roller) 2 serving as a charging unit, a laser exposure optical system (exposure device) 3 serving as an exposure unit, a developing device 4 serving as a developing unit, and a primary transfer roller 5 serving as a primary transfer unit, and a cleaner 6 serving as a cleaning unit.

The intermediate transfer belt 7 is disposed so as to face the photosensitive drums 1*a* to 1*e* of the first to fifth stations Pa to Pe. The intermediate transfer belt 7 is stretched around a driving roller 71, a secondary transfer opposing roller 72, and a driven roller 73. The torque transmitted to the driving roller 71 endlessly moves (rotates) the intermediate transfer belt 7 in the direction of an arrow. Inside the intermediate transfer belt 7, primary transfer rollers 5*a* to 5*e* are disposed opposite the photosensitive drums 1*a* to 1*e* of the stations Pa to Pe. The primary transfer rollers 5*a* to 5*e* are in contact with the intermediate transfer belt 7 and are pressed against the photosensitive drums 1*a* to 1*e*, thereby forming primary transfer portions (primary transfer nips) N1*a* to N1*e* where the intermediate transfer belt 7 is in contact with the photosensitive drums 1*a* to 1*e*. A secondary transfer roller (secondary transfer device) 8 is in contact with the secondary transfer opposing roller 72 with the intermediate transfer belt 7 therebetween, thereby forming a secondary transfer portion (secondary transfer nip) N2 where the secondary transfer roller 8 is in contact with the intermediate transfer belt 7.

When an image is formed, the photosensitive drum 1 is rotated in the direction of an arrow in the figure, and the surface of the rotating photosensitive drum 1 is uniformly charged by the charging device 2. The exposing device 3 irradiates the photosensitive drum 1 with light in accordance with image information of the color corresponding to the station P, thereby forming an electrostatic image (latent image) on the photosensitive drum 1. Next, the developing device 4 reversal-develops the electrostatic image on the photosensitive drum 1, thereby forming a resin-and-pigment-based toner image on the photosensitive drum 1. At this time, a development bias is applied to the developing device 4. The toner image formed on the photosensitive drum 1 is transferred (primary-transferred) onto the intermediate transfer belt 7 by the primary transfer roller 5. At this time, a primary transfer bias is applied to the primary transfer roller 5.

When a full-color image including transparent toner is formed, the above-described operation is performed in the first to fifth stations Pa to Pe. In the primary transfer portions N1*a* to N1*e*, toner images are transferred onto the intermediate transfer belt 7 in a superposed manner, and a full-color toner image including transparent toner is formed.

Thereafter, the full-color toner image is transferred (secondary-transferred) onto a sheet S of recording material. At this time, a secondary transfer bias is applied to the secondary transfer roller 8. Sheets S are conveyed from a container one at a time. Each sheet S is conveyed to the secondary transfer section N2 at a desired timing. After the toner image is transferred onto the sheet S in the secondary transfer section N2, the sheet S is conveyed to a thermal roller fixing device 9 through the conveying portion. The unfixed toner image on the sheet S is fixed in the fixing device 9. The sheet S is ejected onto an output tray (not shown) or into a post-processing apparatus (not shown). After the primary transfer process, the residual toner on the photosensitive drum 1 is removed by the cleaner 6. After the secondary transfer process, the residual toner on the intermediate transfer belt 7 is removed by a belt cleaner 75 (intermediate transfer member cleaning device). A sensor 74 is disposed opposite the driven roller 73 located downstream in the moving direction of the intermediate transfer belt 7. The sensor 74 detects the deviation and the density of the images transferred from the photosensitive drums 1*a* to 1*e* onto the intermediate transfer belt 7. A controller (not shown) controls the image forming apparatus. In accordance with the detection result of the sensor 74, the controller corrects the image density, toner supply, timing of image writing, and starting position of image writing of each of the stations Pa to Pe as needed.

Next, image formation using transparent toner and colored toners will be described. In this embodiment, in a region where image formation is possible, a small amount of transparent toner is superposed on a part where the amount of colored toners is large, and a large amount of transparent toner is superposed on a part where the amount of colored toners is small. That is, transparent toner reduces a difference in level of colored toners on a recording material. Since the multiple toner image has a substantially even surface, the gloss and flatness of the image are improved. In a colored (yellow, magenta, cyan, and black) toner image forming apparatus, when the total maximum amount of the four colors of toner per unit area on a recording material is 200% (when the maximum amount of one color of toner per unit area is 100%), the maximum amount of transparent toner per unit area can be substantially the same as the total maximum amount of the four colors of toner per unit area. It is necessary for the transparent toner developing device to use up to twice the amount of toner used in each colored toner developing device. As long as the multiple toner image combining a transparent toner image and colored toner images has a substantially even surface, any method for image formation using transparent toner can be used in the present invention. For example, a method including optically reading the image of the document on the document plate with the reader unit B, calculating the amount of each color of toner in each pixel in accordance with electric signals color-separated on a pixel to pixel basis, and equalizing the total amount of toner in all pixels with transparent toner on the basis of the calculation result, can be used. In this case, the transparent toner image is formed as follows. First, a toner height calculating unit calculates the toner height of the colored toner image portion formed on the surface of the recording material from the image data. Next, a transparent toner amount calculating unit calculates the amount of transparent toner in each part from the difference between the toner height of the image portion and the maximum toner height, and an amount of transparent toner necessary to eliminate a difference in level of the colored toner image is put on the toner image. As described above, in the image forming unit using transparent toner, an electrostatic latent image is formed by exposing the photosensitive drum depending on the image information of the other image forming units. On the basis of the electrostatic latent image, a transparent toner image is formed.

Figure 2:
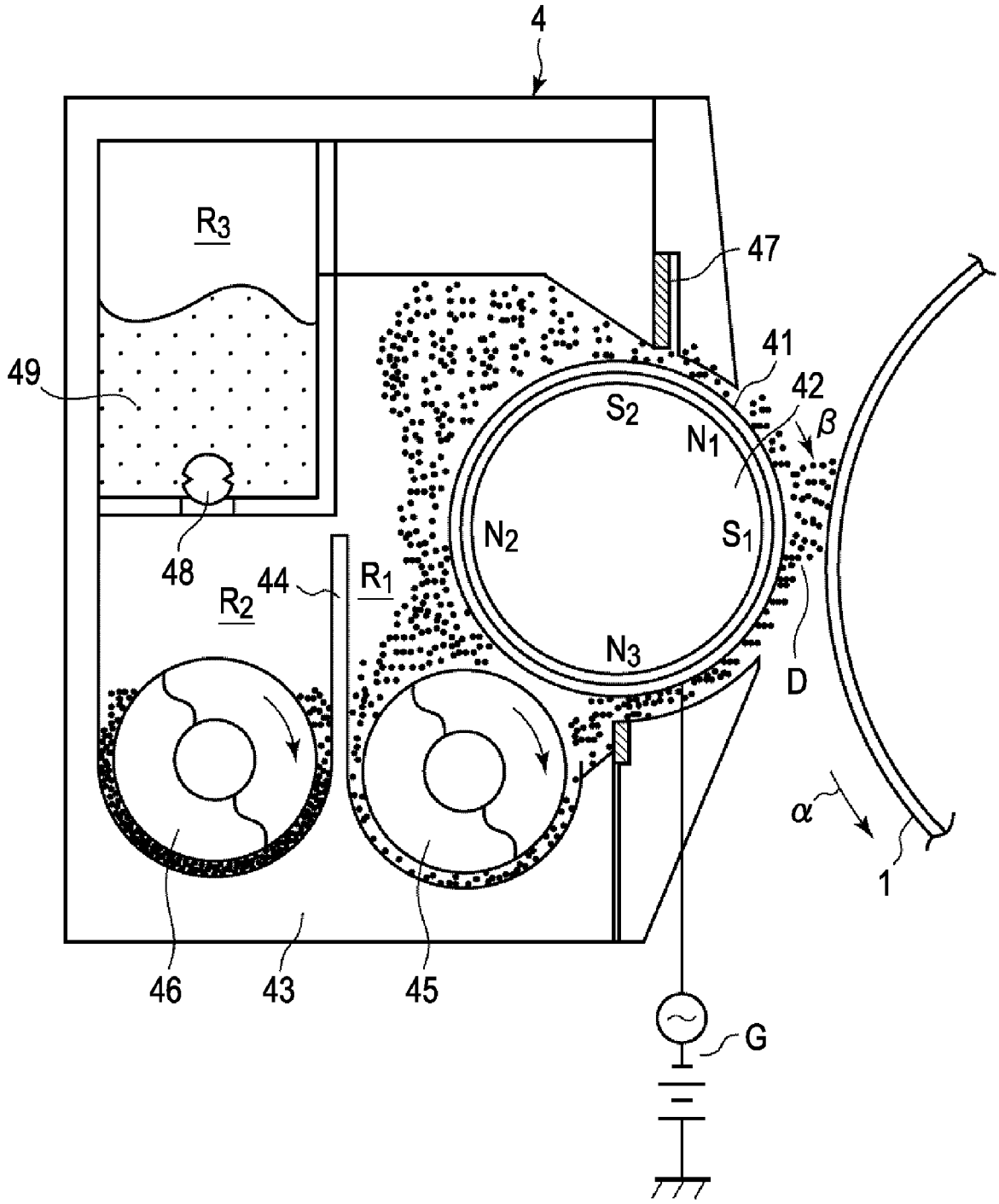
FIG. 2 is a schematic sectional view of a colored toner developing device.

Next, the developing device 4 for making the dot distribution electrostatic image formed on the photosensitive drum 1 visible will be further described with reference to FIG. 2. In this embodiment, as described below in detail, all developing devices 4*a* to 4*e* have substantially the same structure except for the rotational direction of the developer bearing member (developing sleeve) and the magnetic pole arrangement.

The inside of a developer container 43 is separated by a partition 44 into a developing chamber (first chamber) R1 and a stirring chamber (second chamber) R2. A toner storage chamber R3 is formed above the stirring chamber R2. The toner storage chamber R3 contains supplemental toner (non-magnetic toner particles) 49. The toner storage chamber R3 has a supply port 48. As much supplemental toner 49 as consumed in development is supplied to the stirring chamber R2 through the supply port 48. The developing chamber R1 and the stirring chamber R2 contain two-component developer mainly including non-magnetic toner particles (toner) and magnetic carrier particles (carrier).

A first conveying screw 45 serving as a developer stirring and conveying device is provided in the developing chamber R1. The rotation of the first conveying screw 45 conveys the developer in the developing chamber R1 along the longitudinal direction of a below-described developing sleeve 41 serving as a developer bearing member.

A second conveying screw 46 serving as a developer stirring and conveying unit is provided in the stirring chamber R2. The rotation of the second conveying screw 46 conveys developer along the longitudinal direction of the developing sleeve 41. The direction in which the second conveying screw 46 conveys developer is opposite to the direction in which the first conveying screw 45 conveys developer.

The partition 44 has openings at each end in the longitudinal direction (the near side and far side in the figure). The developer conveyed by the first conveying screw 45 is transferred to the second conveying screw 46 through one of the openings. The developer conveyed by the second conveying screw 46 is transferred to the first conveying screw 45 through the other of the openings. In this way, developer is circulated in the developer container 43.

With image formation, the supplemental toner 49 is supplied from the toner storage chamber R3 to the stirring chamber R2 at a desired timing as needed so that the toner density (the ratio of the weight of toner to the weight of developer, or the amount of toner) in the developing device 4 is maintained constant. The toner storage chamber R3 is supplied with supplemental toner 49 from a supplemental toner container (not shown) as needed.

The developer container 43 has an opening provided in a part adjacent to the photosensitive drum 1. In this opening is provided a cylinder formed of nonmagnetic material such as aluminum or nonmagnetic stainless steel, that is, a developing sleeve 41 serving as a developer bearing member.

The minimum gap between the developing sleeve 41 and the photosensitive drum 1 can be at least 0.2 mm but no more than 1 mm. This minimum gap is located in the developing portion D. In this embodiment, in every developing device 4, the minimum gap between the developing sleeve 41 and the photosensitive drum 1 is set to about 0.4 mm so that development can be performed with the two-component developer conveyed to the developing portion D in contact with the photosensitive drum 1.

A vibration bias voltage in which a direct-current voltage is superimposed on an alternating-current voltage is applied to the developing sleeve 41 from a development bias electric source G serving as a development bias outputting device. The dark part potential (unexposed part potential) VD and the light part potential (exposed part potential) VL of the electrostatic image are between the maximum and minimum values of the vibration bias voltage. An alternating electric field is formed in the developing portion D. In this alternating electric field, the toner and carrier vibrate significantly. The toner is released from the electrostatic binding force of the developing sleeve 41 and the carrier adheres to the photosensitive drum 1 in accordance with the electrostatic image. The difference between the maximum and minimum values of the vibration bias voltage (interpeak voltage) can be at least 0.5 kV but no more than 2 kV. The frequency can be at least 1 kHz but no more than 12 kHz. Waveforms of the vibration bias voltage include rectangular waves, sine waves, and triangular waves. The direct-current voltage component of the vibration bias voltage has a value between the dark part potential VD and the light part potential VL of the electrostatic image. The direct-current voltage component can have a value near the dark part potential VD in terms of preventing adhesion of toner to the dark-part potential region. In this embodiment, in every developing device 4, the interpeak voltage is 1.5 kV and the frequency is 12 kHz.

Next, the two-component developer used in this embodiment will be described. Known toners made by adding colorant, charging control material, and so forth to binder resin can be used. The volume average particle diameter of toner can be at least 5 μm but no more than 15 μm. In this embodiment, every toner (transparent, C, M, Y, Bk) has a volume average particle diameter of about 6 μm. Colored toners can be prepared so that the optical density after fixation is 1.6 when the amount of one colored toner per unit area on the recording material S is about 0.5 mg/cm$^2$. Particles that are highly transmissive and that are formed of resin without colorant can be used as transparent toner. Transparent toner is substantially colorless and transmits at least visible light substantially without scattering. The charging polarity of toner is not limited. In this embodiment, every toner is negatively charged. In this embodiment, every toner has substantially the same average charge amount due to friction with carrier (charge amount per unit weight) of about $-3.0\times10^{-2}$ C/kg. In this embodiment, the toner-to-carrier ratio (by weight) is set to about 8% by weight in every color of toner.

Known carriers can be used, for example, resin carriers made by dispersing magnetite as a magnetic material in resin and dispersing a conductive substance such as carbon black for providing conductive property and adjusting resistance, carriers made by oxidizing/reducing the surface of simple substance magnetite such as ferrite to adjust resistance, or carriers made by coating the surface of simple substance magnetite such as ferrite with resin to adjust resistance. These example carriers can be produced utilizing known methods. The present invention does not limit the method for manufacturing carrier.

Next, the rotational direction of the developing sleeve in each colored toner developing device and that in the transparent toner developing device will be described. In each colored toner developing device, the developing sleeve 41 rotates in the direction of arrow β in FIG. 2 and bears and conveys developer, a mixture of toner and carrier, to the developing portion (developing region) D where the photosensitive drum 1 and the developing sleeve 41 are opposite each other. The photosensitive drum 1 rotates in the direction of arrow α in FIG. 2. That is, this embodiment uses the forward developing method in which the moving direction of the surface of the developing sleeve 41 is the same as that of the photosensitive drum 1 in the developing portion D. The rotational direction of the photosensitive drum 1 is opposite to the rotational direction of the developing sleeve 41. The peripheral speed of the developing sleeve 41 is 150 mm/sec. The peripheral speed of the photosensitive drum 1 is 100 mm/sec. The ratio of the peripheral speed of the developing sleeve 41 to the peripheral speed of the photosensitive drum 1 is 150%.

A developing blade 47 serving as a developer layer thickness limiting member is disposed upstream of the developing portion D in the rotational direction of the developing sleeve 41. The developing blade 47 limits the layer thickness of two-component developer that the developing sleeve 41 bears and conveys to the developing portion D. The amount of developer (amount of developer coat) limited by the developing blade 47 and conveyed to the developing portion D is substantially the same in all developing devices 4. In this embodiment, the amount of developer coat per unit area of the developing sleeve 41 is limited to about 30 mg/cm$^2$. The magnetic brush of developer borne by the developing sleeve 41 comes into contact with the photosensitive drum 1 in the developing portion D. The electrostatic image on the photosensitive drum 1 is developed in the developing portion D. Since the above-described so-called forward developing method is used in the colored toner developing devices, graininess due to the friction of carrier is minimized and excellent image quality is obtained. In addition, it is confirmed that the missing image phenomenon, which is a concern in the forward developing method, does not occur when the amount of toner per unit area is about 0.5 mg/cm$^2$ or less. Since the colored toner used in this embodiment is prepared so that the optical density after fixation is 1.6 when the amount of one colored toner per unit area on the recording material S is 0.5 mg/cm$^2$, a high-density image can be formed without problems. In each colored toner developing device using the forward developing method, a roller-shaped magnet 42 serving as a magnetic field generator is immovably disposed in the developing sleeve 41. In this embodiment, the magnet 42 has poles N1, N2, N3, and S2 in addition to a developing pole S1. The poles N1, N2, and N3 are north poles of magnet. The poles S1 and S2 are south poles of magnet. Scooped up by the rotating developing sleeve 41 at the pole N2, the developer is conveyed through the pole S2 to the pole N1. While being conveyed from the pole S2 to the pole N1, the developer is limited by the developing blade 47 and forms a thin layer of developer. Next, the developer forms a magnetic brush in the magnetic field of the developing pole S1 and develops the electrostatic image on the photosensitive drum 1. Thereafter, due to the repelling magnetic field between the poles N3 and N2, the developer on the developing sleeve 41 falls into the developing chamber R1. The developer fallen into the developing chamber R1 is stirred and conveyed by the first conveying screw 45 and the second conveying screw 46.

Figure 3:
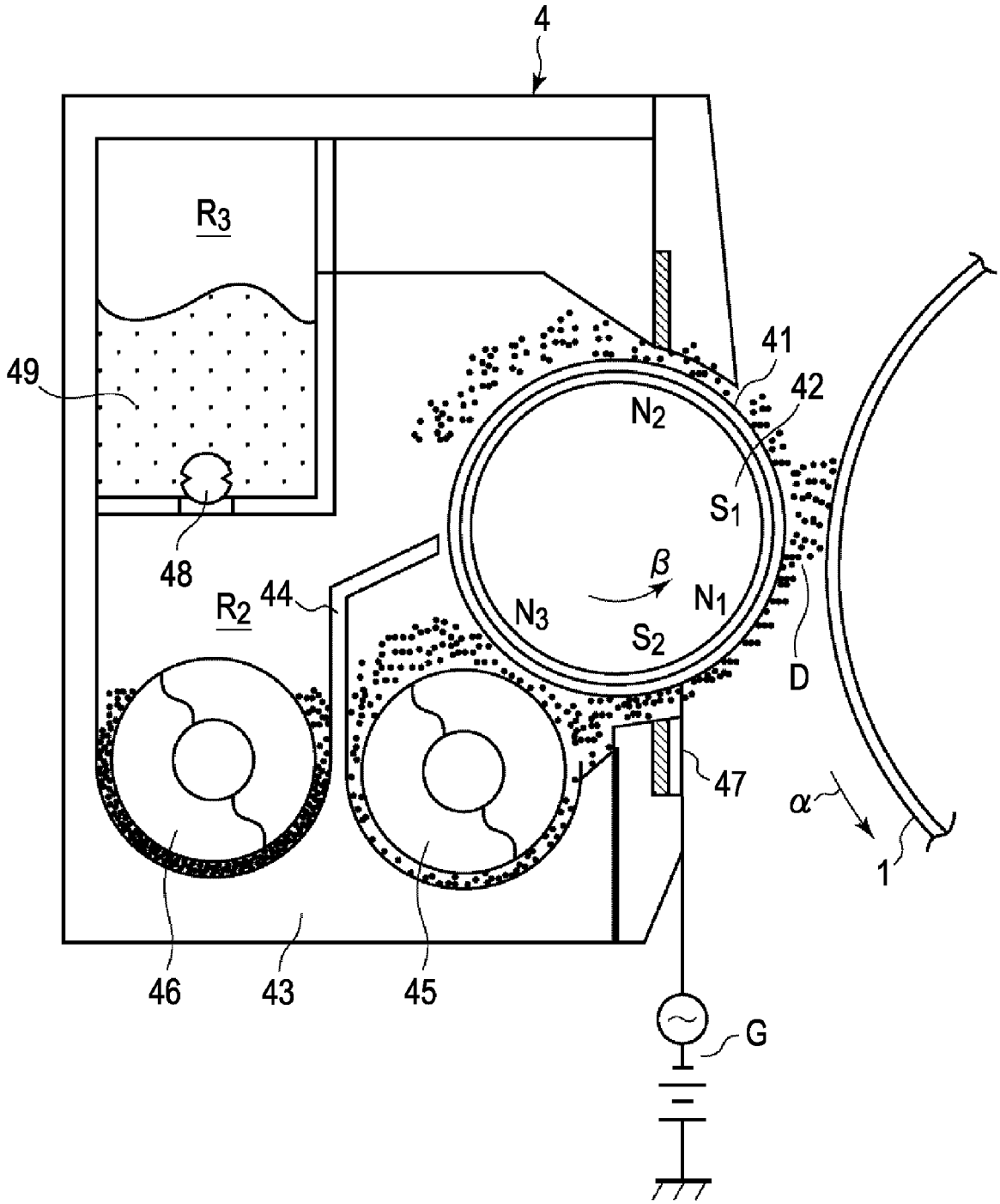
FIG. 3 is a schematic sectional view of a transparent toner developing device.
Figure 4:
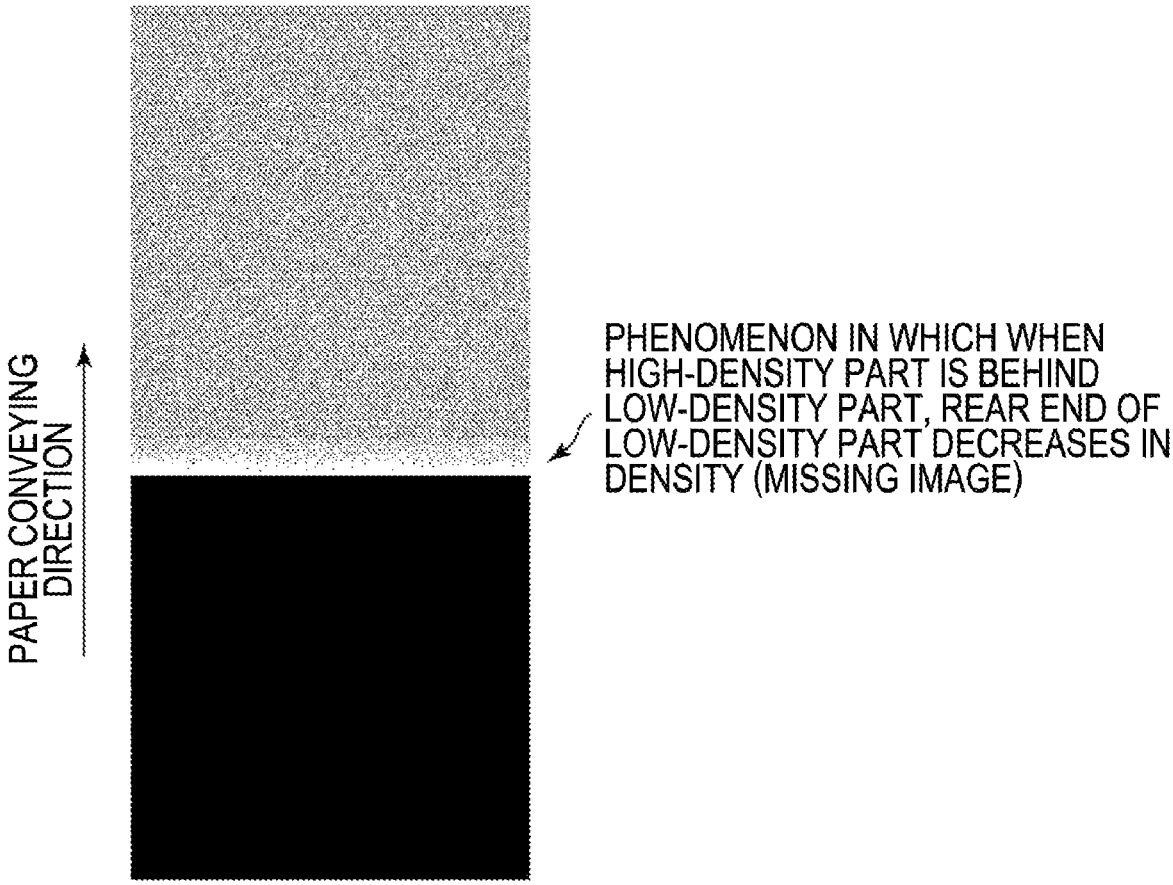
FIG. 4 PRIOR ART
FIG. 4 shows a missing image phenomenon.
Figure 5A:
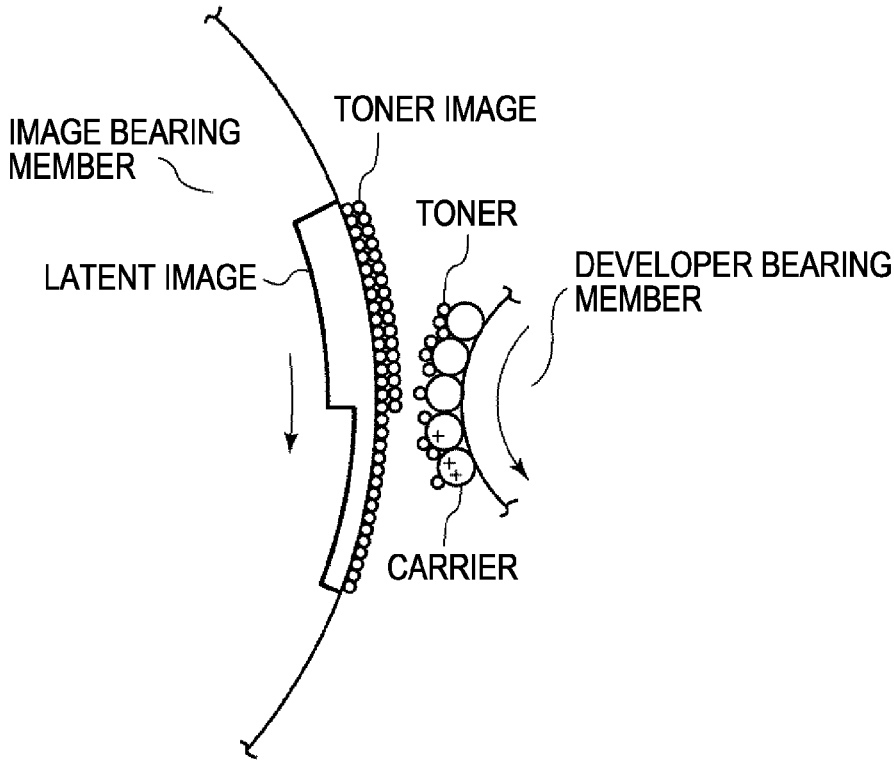
FIGS. 5A and 5B are enlarged views of a developing region.
Figure 5B:
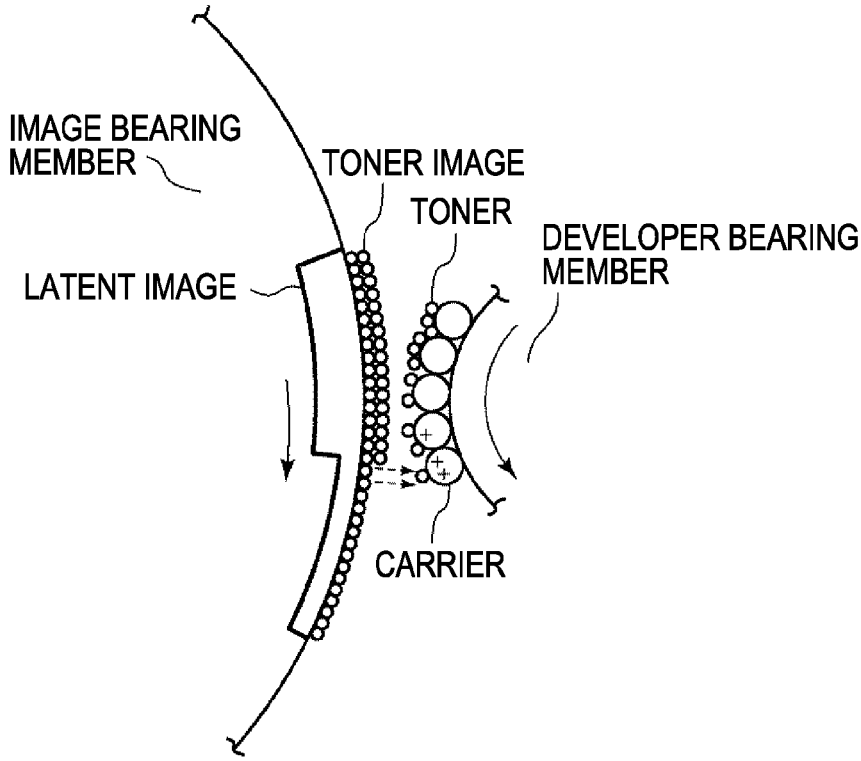

In contrast, in the transparent toner developing device, the developing sleeve 41 rotates in the direction of arrow β in FIG. 3, opposite to the rotational direction of the developing sleeve of each colored toner developing device. The developing sleeve 41 bears and conveys developer, a mixture of toner and carrier, to the developing portion (developing region) D where the photosensitive drum 1 and the developing sleeve 41 are opposite each other. The photosensitive drum 1 rotates in the direction of arrow α in the figure. That is, this embodiment uses the counter developing method in which the moving direction of the surface of the developing sleeve 41 is opposite to that of the photosensitive drum 1 in the developing portion D. The rotational direction of the photosensitive drum 1 is the same as the rotational direction of the developing sleeve 41. The peripheral speed of the developing sleeve 41 is 150 mm/sec. The peripheral speed of the photosensitive drum 1 is 150 mm/sec. A developing blade 47 serving as a developer layer thickness limiting member is disposed upstream of the developing portion D in the rotational direction of the developing sleeve 41. The developing blade 47 limits the layer thickness of two-component developer that the developing sleeve 41 bears and conveys to the developing portion D. In this embodiment, the amount of developer coat per unit area of the developing sleeve 41 is limited to 30 mg/cm$^2$ as in each colored toner developing device. The magnetic brush of developer borne by the developing sleeve 41 comes into contact with the photosensitive drum 1 in the developing portion D. The electrostatic image on the photosensitive drum 1 is developed in the developing portion D. In this embodiment, the total maximum amount of toner per unit area in the colored toner developing devices is 200% (when the maximum amount of one color of toner per unit area is 100%). In the transparent toner developing device, a maximum amount of toner per unit area of about 1.0 mg/cm$^2$ is necessary. That is, the maximum amount of toner per unit area of the colored toner image on the recording material or the intermediate transfer member is substantially the same as the maximum amount of toner per unit area of the transparent toner image. In the transparent toner developing device using the counter developing method, a roller-shaped magnet 42 serving as a magnetic field generator is immovably disposed in the developing sleeve 41. In this embodiment, the magnet 42 has poles N1, N2, N3, and S2 in addition to a developing pole S1. The poles N1, N2, and N3 are north poles of magnet. The poles S1 and S2 are south poles of magnet. Scooped up by the rotating developing sleeve 41 at the pole N3, developer is conveyed through the pole S2 to the pole N1. While being conveyed from the pole S2 to the pole N1, the developer is limited by the developing blade 47 and forms a thin layer of developer. Next, the developer forms a magnetic brush in the magnetic field of the developing pole S1 and develops the electrostatic image on the photosensitive drum 1. Thereafter, due to the repelling magnetic field between the poles N2 and N3 pole, the developer on the developing sleeve 41 falls into the developing chamber R2.

The reason why the counter developing method is used in the transparent toner developing device will be described. Since the transparent toner developing device needs a very large maximum amount of toner per unit area (1.0 mg/cm$^2$), the missing image phenomenon occurs significantly if the forward developing method is used. The missing image phenomenon tends to become more significant with the increase in the maximum amount of toner per unit area under a condition in which the charge amount of toner per unit mass is equal. With the increase in the amount of toner per unit area, more negative toner moves from the two-component developer to the image bearing member, and therefore the positive charge amount of the two-component developer left behind increases. As a result, the Coulomb's force between the negative toner on the image bearing member and the two-component developer increases, and therefore the missing image worsens. Therefore, in the transparent toner developing device, the missing image is prevented from occurring by using the counter developing method. When the counter developing method is used, the relative speed between the photosensitive drum and the developing sleeve increases, and therefore there is fear of worsening of graininess of image due to carrier friction. However, the graininess of image is a visual bad effect caused by low frequency disturbance in the image density. Since transparent toner is colorless, the graininess is not a problem.

As described above, the scattering of transparent toner can be reduced, and the amount of transparent toner per unit area can be stabilized regardless of the image to achieve a uniform gloss.

In the above-described embodiment, the image forming apparatus uses an intermediate transfer method. However, the present invention is not limited to this and can also be applied to direct transfer type image forming apparatuses known to those skilled in the art. Direct transfer type image forming apparatuses have a recording material bearing member that bears and conveys a recording material, for example, a conveying belt. A plurality of image bearing members are provided along the moving direction of the surface of the conveying belt. Toner images formed on the image bearing members are successively transferred in a superposed manner onto a recording material borne on the conveying belt so that an image of a plurality of colors of toner can be formed.

In the above-described embodiment, the number of image bearing members is the same as the number of developing devices. However, the present invention is not limited to this. The number of image bearing members may be smaller than the number of developing devices. The present invention can also be applied to an image forming apparatus that includes an image bearing member and a plurality of developing devices and that forms an image of a plurality of colors of toner by transferring toner images successively formed on the image bearing member onto a recording material directly or after transferring onto an intermediate transfer member.

Figure 6:
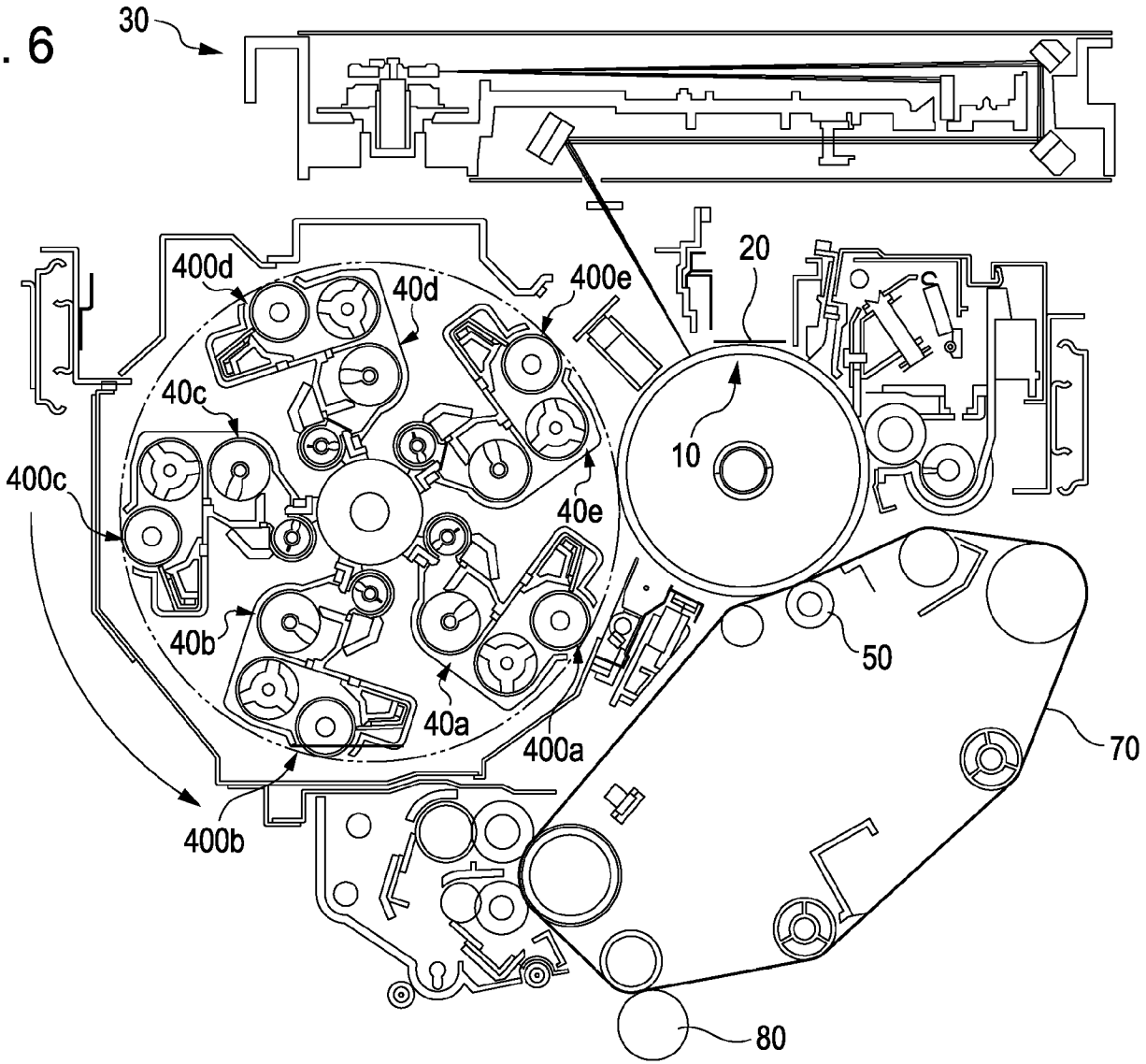
FIG. 6 is a schematic sectional view showing the structure of another image forming apparatus according to an embodiment of the present invention.

An image forming apparatus shown in FIG. 6 has an image bearing member 10 and a plurality of developing devices. The plurality of developing devices are attached to a rotary. The rotary rotates in the direction of an arrow. Each developing device moves to a position opposite the image bearing member (photosensitive drum). A toner image of each color is formed on the image bearing member. The plurality of developing devices include a yellow developing device 40*a*, a magenta developing device 40*b*, a cyan developing device 40*c*, a black developing device 40*d*, and a transparent toner developing device 40*e*. Each developing device has a sleeve (400*a*, 400*b*, 400*c*, 400*d*, 400*e*) serving as a developer bearing member that bears toner and carrier. Image formation will be described. The photosensitive drum is charged by a charging member 20 and is then exposed by an exposure unit 30 so that an electrostatic latent image is formed on the photosensitive drum. Thereafter, a toner image is formed by a developing device opposite the photosensitive drum. The toner image is transferred to an intermediate transfer member 70 by a first transfer roller 50. After completion of formation of a toner image by an opposite developing device, the rotary rotates so that another toner image is formed by another developing device in the same manner. Toner images are sequentially superposed on the intermediate transfer member so that a color toner image including a transparent toner image is formed. Thereafter, the color toner image formed on the intermediate transfer member 70 is transferred onto a conveyed recording material by a first transfer roller 80. The color toner image is fixed to the recording material by a fixing device. In such an image forming apparatus, the advantages of the present invention can be obtained by rotating the colored toner developer bearing members in the direction opposite to the rotational direction of the image bearing member and rotating the transparent toner developer bearing member in the same direction as the rotational direction of the image bearing member.

There is known an image forming apparatus that uses toners equal in hue to but different in density from magenta and cyan toners (light magenta and light cyan toners) in conjunction with the magenta and cyan toners. In this case, the forward developing method is used in each of the developing devices that use light magenta and light cyan toners as in the colored toner developing devices of the above-described embodiment. This makes it possible to reduce the scattering of transparent toner, and to stabilize the amount of transparent toner per unit area regardless of the image to achieve a uniform gloss.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-344277 filed Dec. 21, 2006, which is hereby incorporated by reference herein in its entirety.

What is claimed is:

1. An image forming apparatus comprising:

a plurality of rotatable image bearing members;

a plurality of colored toner developing units each having a developer bearing member configured to bear toner and carrier, the colored toner developing units being configured to form a toner image on the image bearing member opposite the developer bearing member; and a transparent toner developing unit having a transparent toner developer bearing member configured to bear transparent toner and carrier, the transparent toner developing unit being configured to form a transparent toner image on the image bearing member opposite the transparent toner developer bearing member, wherein a maximum amount of toner formed by the transparent toner developing unit is larger than a maximum amount of toner formed by at least one of the colored toner developing units, and wherein a rotational direction of the developer bearing members of the colored toner developing units is opposite to a rotational direction of the corresponding image bearing members, and a rotational direction of the transparent toner developer bearing member is the same as a rotational direction of the corresponding image bearing member.

2. The image forming apparatus according to claim 1, wherein a maximum possible amount per unit area of the transparent toner on the recording material is substantially the same as a maximum possible amount per unit area of the colored toners on the recording material.

3. The image forming apparatus according to claim 1, wherein the rotational speed of the developer bearing members of the colored toner developing units is faster than the rotational speed of the corresponding image bearing members.

4. The image forming apparatus according to claim 1, wherein a charge amount per unit mass (μC/g) of the yellow, magenta, cyan, and black toners is substantially the same as a charge amount per unit mass (μC/g) of the transparent toner.

5. The image forming apparatus according to claim 1, wherein the colored toners include yellow, magenta, cyan, and black toners.

6. An image forming apparatus comprising:

a rotatable image bearing member;

a plurality of colored toner developing units each having a developer bearing member configured to bear toner and carrier, the colored toner developing units being configured to form toner images on the image bearing member; and a transparent toner developing unit having a transparent toner developer bearing member configured to bear transparent toner and carrier, the transparent toner developing unit being configured to form a transparent toner image on the image bearing member, wherein a maximum amount of toner formed by the transparent toner developing unit is larger than a maximum amount of toner formed by at least one of colored toner developing units, and wherein a rotational direction of the developer bearing members of the colored toner developing units is opposite to a rotational direction of the image bearing member, and a rotational direction of the transparent toner developer bearing member is the same as a rotational direction of the image bearing member.

7. The image forming apparatus according to claim 6, wherein a maximum possible amount per unit area of the transparent toner on the recording material is substantially the same as a maximum possible amount per unit area of the colored toners on the recording material.

8. The image forming apparatus according to claim 6, wherein a rotational speed of the developer bearing members of the colored toner developing units is larger than a rotational speed of the corresponding image bearing member.

9. The image forming apparatus according to claim 6, wherein a charge amount per unit mass (μC/g) of the colored toners is substantially the same as a charge amount per unit mass (μC/g) of the transparent toner.

10. The image forming apparatus according to claim 6, wherein the colored toners include yellow, magenta, cyan, and black toners.

* * * * *